US007142226B2

(12) United States Patent
Sakuta et al.

(10) Patent No.: US 7,142,226 B2
(45) Date of Patent: Nov. 28, 2006

(54) DISPLAY DEVICE AND IMAGE DISPLAY SYSTEM

(75) Inventors: Junji Sakuta, Ishikawa (JP); Naoaki Hirata, Ishikawa (JP); Kenyu Mizukabu, Ishikawa (JP)

(73) Assignee: Eizo Nanao Corporation, Ishikawa (JP)

( * ) Notice: Subject to any disclaimer, the term of this patent is extended or adjusted under 35 U.S.C. 154(b) by 534 days.

(21) Appl. No.: 10/141,946

(22) Filed: May 10, 2002

(65) Prior Publication Data

US 2002/0175946 A1 Nov. 28, 2002

(30) Foreign Application Priority Data

May 11, 2001 (JP) ..... 2001-141901

(51) Int. Cl.
*G09G 5/10* (2006.01)
*G09G 5/00* (2006.01)

(52) U.S. Cl. ..... 345/690; 345/211

(58) Field of Classification Search ..... 345/204, 345/211, 690–699
See application file for complete search history.

(56) References Cited

U.S. PATENT DOCUMENTS 5,420,605 A * 5/1995 Vouri et al. ..... 345/698
5,654,743 A 8/1997 Hu et al.
6,057,860 A 5/2000 Hoffert et al.
6,476,821 B1 * 11/2002 Sawada et al. ..... 345/620

FOREIGN PATENT DOCUMENTS

| | | | |
|---|---|---|---|
| DE | 44 04 104 | A1 | 8/1994 |
| EP | 0 612 053 | A1 | 8/1994 |
| EP | 0 856 829 | A2 | 8/1998 |
| JP | 61-163383 | | 7/1986 |
| JP | 04360228 | A * | 12/1992 |
| JP | 7-225575 | | 8/1995 |
| JP | 8-251503 | | 9/1996 |
| JP | 11-102278 | A1 | 4/1999 |
| JP | 11-296338 | A1 | 10/1999 |

OTHER PUBLICATIONS

European Search Report for application No. EP02010589 completed on Nov. 12, 2004.

* cited by examiner

*Primary Examiner*—Alexander Eisen
(74) *Attorney, Agent, or Firm*—Reader, Fishman & Grauer PLLC

(57) ABSTRACT

In a display device, parameters for adjusting a video circuit are previously made to correspond to application softwares, respectively and a control section for determining an application software and adjusting the video circuit by means of the parameters are provided. Since the image quality of the display device can be automatically changed over to a suitable image quality according to a selected application software, a burden on the user is extremely small, and the image quality of the display device can be adjusted according to the application software extremely easily.

44 Claims, 4 Drawing Sheets

Fig.2

PARAMETER TABLE

| IMAGE QUALITY MODE | CONTRAST | BRIGHTNESS | COLOR TEMPERATURE | GAMMA 1 (LOW GRADATION PORTION) | GAMMA 2 (MEDIUM GRADATION PORTION) | OUTLINE CORRECTION |
|---|---|---|---|---|---|---|
| Text | 100 | 100 | 9300K | OFF | OFF | OFF |
| Browser | 100 | 100 | 6500K | −11.25% | +5% | OFF |
| Picture | 120 | 75 | 6500K | −7.50% | +2.50% | ON |
| Graphic | 120 | 75 | 9300K | OFF | OFF | OFF |
| sRGB | 80 | 70 | 6500K | ±0% | −5% | OFF |
| Movie1 | 143 | 100 | 9300K | −11.25% | +5% | ON |
| Movie2 | 143 | 100 | 9300K | −11.25% | +5% | OFF |
| Movie3 | 143 | 100 | 9300K | OFF | OFF | ON |
| Movie4 | 143 | 100 | 9300K | OFF | OFF | OFF |

※: Numerical values of contrast and brightness parameters are adjusting values when a default value is 100.

※: Numerical values of gamma parameters are gamma correcting peak values at an inflection point when a gamma correcting value as a basis is 100%. Moreover, + and − show polarities of correction.

Fig.3

IMAGE QUALITY MODE TABLE

| APPLICATION SOFTWARE | IMAGE QUALITY MODE | IMAGE QUALITY ADJUSTING VALUE | |
|---|---|---|---|
| | | GAMMA VALUE | RESOLUTION |
| WORD PROCESSOR | Text | $\gamma - 1$ | R − 1 |
| SPREAD SHEET | Text | $\gamma - 2$ | R − 2 |
| RETOUCH | Graphic | $\gamma - 3$ | R − 3 |
| DYNAMIC IMAGE REPRODUCTION | Window Movie | $\gamma - 4$ | R − 4 |
| ..... | ..... | ..... | ..... |
| ..... | ..... | ..... | ..... |
| ..... | ..... | ..... | ..... |
| ⋮ | ⋮ | ⋮ | ⋮ |

DISPLAY DEVICE AND IMAGE DISPLAY SYSTEM

BACKGROUND OF THE INVENTION (1) Field of the Invention

The present invention relates to a display device and an image display system for displaying images on a display device, such as a display device using a liquid crystal display device or a display device using a CRT, according to output signals from a graphic controller mounted to a computer.

(2) Description of the Related Art

On a display device connected to a computer, application softwares which are executed by the computer according to user's processing objects are displayed. Generally, a plurality of windows are displayed on the display device, and images of the application softwares are displayed in the respective windows.

As the above-mentioned application softwares, for example, there are a word processor for mainly processing texts, a retouch software for mainly processing photographic images and the like. The image quality of texts, which is desirable for a user to perform operations comfortably, is greatly different from that of photographic images. Therefore, in a conventional display device, the user adjusts the image quality suitably according to an application software being used.

However, there is the following problem in such conventional display device.

Namely, since a plurality of windows are displayed on the display device and application softwares are displayed in the respective windows, once the user adjusts the image quality of the display device suitably for a word processor, for example, the image quality remains the same even when the user selects a retouch software window behind the word processor window. The user has to use the retouch software with the image quality which is not suitable for the retouch software, or has to readjust the image quality so as to be suitable for the retouch software. Thus, it is troublesome to manually adjust the image quality every time a different software is selected.

In order to reduce the above troublesome operation, there exists a method in which various image qualities are preset in a display device, and whenever a user changes over application softwares, the user manually selects one image quality suitable for the software being currently selected among the preset image qualities, using an image quality selection button provided to the display device. However, even if such method is used, adjustment and changeover of image quality is still troublesome for the user.

SUMMARY OF THE INVENTION

The present invention is devised in view of such situation, and its object is to provide a display device and an image display system which can extremely easily adjust an image quality suitably for a selected application software by automatically changing over the image quality using parameters which previously made to correspond to respective application softwares.

In one aspect of the invention, a display device for displaying images is provided which includes:

a video circuit for outputting signals for displaying images according to output signals from a graphic controller included in a computer; and wherein parameters for adjusting the video circuit are previously made to correspond to application softwares, control means for, when an application software which is executed by the computer and is selected by a user is an active application, adjusting the video circuit by means of the parameters corresponding to the active application.

Since the control means adjusts the video circuit using the parameters corresponding to the active application softwares, the image quality of the display device can be automatically changed over to a suitable image quality for the selected application software. Therefore, a burden on the user is extremely small, and the image quality of the display device can be adjusted according to the application software extremely easily.

In another aspect of the invention, a display device for displaying images is provided which includes:

a video circuit for outputting signals for displaying images according to output signals from a graphic controller included in a computer; and wherein parameters for adjusting the video circuit are previously made to correspond to display states of application softwares, control means for, when an application software which is executed by the computer and is selected by a user is an active application, adjusting the video circuit by means of the parameters corresponding to the display state of the active application.

Since the control means adjusts the video circuit using the parameters corresponding to the display states of the active application softwares, the image quality of the display device can be automatically changed over to a suitable image quality for the display state of the selected application software. Therefore, a burden on the user is extremely small, and the image quality of the display device can be adjusted according to the display state of the application software extremely easily.

In another aspect of the invention, a display device for displaying images is provided which includes:

a video circuit for outputting signals for displaying images according to output signals from a graphic controller included in a computer;

a communication interface to be used for communication with the computer;

first storage means for previously storing a parameter table in which application softwares to be executed by the computer are made to correspond to parameters for adjusting the video circuit, respectively; and control means for, when an application software which is executed by the computer and is selected by a user is an active application, determining the active application via the communication interface and adjusting the video circuit by means of the parameters corresponding to the active application based on the parameter table.

The object of the invention is accomplished also by the display device thus constructed.

In another aspect of the invention, a display device for displaying images is provided which includes:

a video circuit for outputting signals for displaying images according to output signals from a graphic controller included in a computer;

a communication interface to be used for communication with the computer;

first storage means for previously storing an image quality mode table in which application softwares to be executed by the computer are made to correspond to image quality modes, respectively and a parameter table in which parameters for adjusting the video circuit are made to correspond to the image quality modes, respectively; and control means for, when an application software which is executed by the computer and is selected by a user is an active application, determining the active application via the communication interface and adjusting the video circuit by means of the parameters corresponding to the active application based on the image quality mode table and the parameter table.

The object of the invention is accomplished also by the display device thus constructed.

In another aspect of the invention, a display device for displaying images is provided which includes:

a video circuit for outputting signals for displaying images according to output signals from a graphic controller included in a computer;

a communication interface to be used for communication with the computer;

first storage means for previously storing a parameter table in which application softwares to be executed by the computer are made to correspond to parameters for adjusting the video circuit, respectively; and control means for, when an application software which is executed by the computer and is selected by a user is an active application, receiving active application information determined by the computer via the communication interface and adjusting the video circuit by means of the parameters corresponding to the active application based on the active application information and the parameter table.

The object of the invention is accomplished also by the display device thus constructed.

In another aspect of the invention, a display device for displaying images is provided which includes:

a video circuit for outputting signals for displaying images according to output signals from a graphic controller included in a computer;

a communication interface to be used for communication with the computer;

first storage means for previously storing an image quality mode table in which application softwares to be executed by the computer are made to correspond to image quality modes, respectively and a parameter table in which parameters for adjusting the video circuit are made to correspond to the image quality modes, respectively; and control means for, when an application software which is executed by the computer and is selected by a user is an active application, receiving active application information determined by the computer via the communication interface and adjusting the video circuit by means of the parameters corresponding to the active application based on the active application information, the image quality mode table and the parameter table.

The object of the invention is accomplished also by the display device thus constructed.

In another aspect of the invention, a display device for displaying images is provided which includes:

a video circuit for outputting signals for displaying images according to output signals from a graphic controller included in a computer;

a communication interface to be used for communication with the computer;

first storage means for previously storing a parameter table in which parameters for adjusting the video circuit are made to correspond to image quality modes, respectively; and control means for, when an application software which is executed by the computer which previously stores an image quality mode table in which application softwares are made to correspond to the image quality modes, respectively and is selected by a user is an active application, adjusting the video circuit by means of the parameters corresponding to the active application based on the image quality mode of the active application determined by the computer and received via the communication interface and the parameter table.

The object of the invention is accomplished also by the display device thus constructed.

In another aspect of the invention, a display device for displaying images is provided which includes:

a video circuit for outputting signals for displaying images according to output signals from a graphic controller included in a computer;

a communication interface to be used for communication with the computer;

control means for, when an application software which is executed by the computer and is selected by a user is an active application, receiving parameters corresponding to the active application via the communication interface based on the active application determined by the computer and a parameter table in which the application softwares to be executed by the computer are made to correspond to the parameters for adjusting the video circuit, respectively and adjusting said video circuit by means of the parameters.

The object of the invention is accomplished also by the display device thus constructed.

In yet another aspect of the invention, a display device for displaying images is provided which includes:

a video circuit for outputting signals for displaying images according to output signals from a graphic controller included in a computer;

a communication interface to be used for communication with the computer;

control means for, when an application software which is executed by the computer which previously stores an image quality mode table in which application softwares are made to correspond to image quality modes, respectively and a parameter table in which the application softwares to be executed by the computer are made to correspond to parameters for adjusting the video circuit, respectively and is selected by a user is an active application, adjusting the video circuit by means of the parameters corresponding to the active application determined by the computer and received via the communication interface.

The object of the invention is accomplished also by the display device thus constructed.

Still further, another aspect of the invention provides an image display system for displaying images, including:

a display device having a video circuit for adjusting an image quality;

a computer having a graphic controller for displaying images on the display device; and a communication interface to be used for communication between the computer and the display device, wherein the display device includes:

first storage means for previously storing a parameter table in which parameters for adjusting the video circuit are made to correspond to application softwares to be executed by the computer, rrespectively; and control means for adjusting the video circuit by means of the parameters, wherein the computer includes determining means for determining an active application, wherein the control means adjusts the video circuit by means of the parameters corresponding to the active application based on active application information received from the computer via the communication interface and the parameter table.

The determining means determined an active application, and the active application information is transmitted to the display device via the communication interface. The display device adjusts the video circuit according to the active application based on the active application information and the parameter table stored in the first storage means so as to adjust the image quality. As a result, the image quality of the display device can be automatically changed over to a suitable image quality for the selected application software, a burden on the user is extremely small, and the image quality of the display device can be adjusted according to the application software extremely easily.

BRIEF DESCRIPTION OF THE DRAWINGS

For the purpose of illustrating the invention, there are shown in the drawings several forms which are presently preferred, it being understood, however, that the invention is not limited to the precise arrangement and instrumentalities shown.

FIG. 2 is a parameter table;

FIG. 3 is an image mode table; and

DETAILED DESCRIPTION OF THE PREFERRED EMBODIMENTS

There will be detailed below preferred embodiments of the present invention with reference to the drawings.

Figure 1:
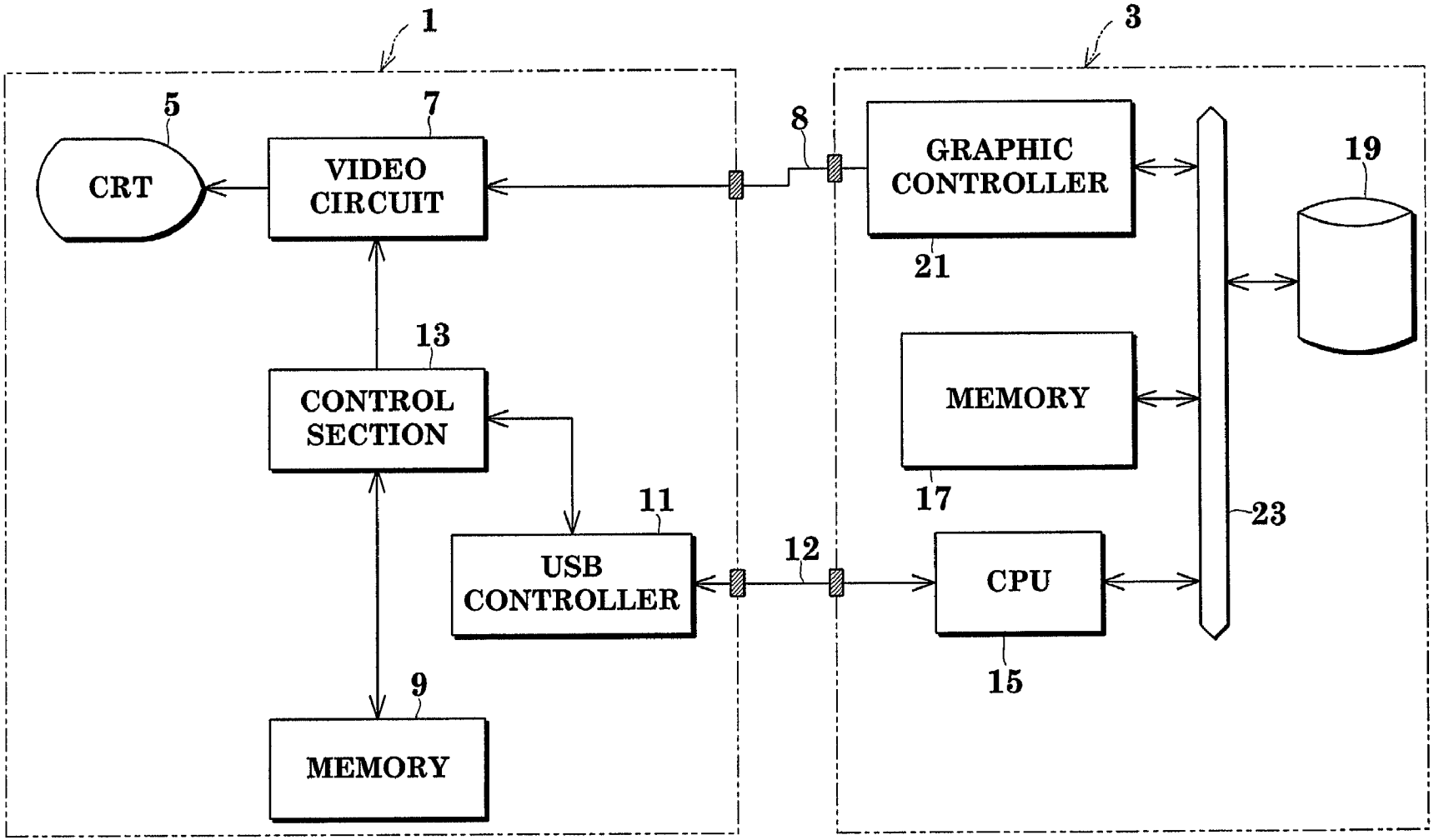
FIG. 1 is a block diagram showing a schematic structure of an image display system according to one embodiment of the invention.

FIG. 1 relates to one embodiment of the present invention, and is a block diagram showing a schematic structure of an image display system including a display device and a computer.

This embodiment corresponds to claims 7 and 57 of the present invention.

This image display system has a display device 1 for displaying images, and a computer 3 for outputting signals, relating to the images, to the display device 1. The display device 1 has, for example, a CRT 5, and displays images based on signals from a video circuit 7. The video circuit 7 is connected to a graphic controller 21 contained in the computer 3 via a video cable 8, and it operates according to output signals from the graphic controller 21.

Optionally, the graphic controller 21 may be provided as a graphic card which is attached to an extension slot of the computer 3.

A memory 9, corresponding to first storage means of the present invention, controls the video circuit 7 and stores parameters for adjusting the image quality of the display device 1. More specifically, the memory 9 stores a parameter table in which image quality modes are previously made to correspond to the parameters so that the image quality of the display device 1 becomes suitable. The details of the parameter table will be mentioned later with reference to FIG. 2.

An USB controller 11, corresponding to a communication interface of the present invention, is connected to the computer via an USB cable 12. The USB controller 11 is used mainly for communication with the computer 3.

A control section 13, corresponding to control means of the present invention, determines an image quality mode of an application software which is executed by the computer 3 and is selected to be active by an user (hereinafter referred to as an "active application").

More specifically, the image quality mode of the active application is obtained from the USB controller 11. Corresponding parameters are extracted based on the parameter table stored in the memory 9 and the image quality mode, and the video circuit 7 is adjusted with the parameters.

The computer 3 has a CPU 15, a memory 17, a hard disc 19 and a graphic controller 21, and they are all connected via a bus 23.

A program, which read from the hard disc 19 and is executed, is located in the memory 17. An image quality mode table (see FIG. 3) is read from the hard disc 19 as the need arises. The program performs correspondence and setting using the image quality mode table, and recognizes which application software is selected by a user from a plurality of application softwares executed by the computer 3 so as to determine its image quality mode.

The hard disc 19 stores an operating system, various programs and the image quality mode table therein.

The CPU 15 corresponds to determining means of the present invention and the memory 17 corresponds to second storage means of the present invention.

The parameter table stored in the memory 9 is formed, for example, as shown in FIG. 2. Namely, the parameter table includes data in a form of a table in which nine kinds of image quality modes are made to correspond to the parameters for adjusting the video circuit, respectively. This correspondence is previously set at the time of the adjustment in factory. Alternatively, the user can set the correspondence freely according to the user's preference.

In this embodiment, nine kinds of image quality modes, that is, Text, Browser, Picture, Graphics, sRGB, Movie 1, Movie 2, Movie 3 and Movie 4, are set as one example.

The "Text" mode is a standard image quality mode which is suitable for writing or reading sentences, and it is suitable mainly for a word processor and the like. The "Browser" mode, in which contrast is slightly enhanced, is an image quality mode which is suitable for displaying images like browsers where sentences and photographs coexist. The "Picture" mode, in which brightness is heightened and contrast is enhanced, is an image quality mode which is suitable for static images such as photographs.

The "Graphic" mode, in which contrast is unchanged and brightness is heightened, is suitable for animations and illustrations. The "sRGB" mode corresponds to sRGB of the Windows standard. This mode is suitable for printings since a color temperature is fixed to 6500K and the same color environment can be created also in another equipment such as a printer.

The "Movie 1" mode, in which brightness is high and contrast is enhanced, is suitable for "full-screen" dynamic images of DVD or TV. The "Movie 2" mode, in which brightness is high and contrast is enhanced, is suitable for standard-sized dynamic images of DVD or TV. In the "Movie 3" mode, brightness is high, contrast is not enhanced and sharpness is provided. In the "Movie 4" mode, brightness is high, contrast is not enhanced and sharpness is not provided.

Each of the above nine kinds of image quality modes includes, for example, contrast, brightness, color temperature, gamma 1 (gamma value of low gradation portion), gamma 2 (gamma value of halftone portion) and outline correction as parameters. These parameters are previously set to default values, or are programmed so as to be capable of being set suitably by the user.

Not all the above-mentioned parameters should be set; one of them may be set.

The image quality mode table stored in the memory 17 is formed as shown in FIG. 3, for example. Namely, it is a table in which the nine kinds of image quality modes and image quality adjusting values for adjusting the graphic controller 21 are made to correspond to the application softwares, respectively. Correspondence is previously carried out by the user as the need arises.

In FIG. 3, "word processor" software is made to correspond to "Text" mode, "spreadsheet" software is made to correspond to "Text" mode, "retouch" software is made to correspond to "Graphic" mode, and "dynamic image reproduction" software is made to correspond to "Window Movie" mode. A typical example of the above-mentioned "word processor" software is Microsoft Word, and a typical example of the above-mentioned "spreadsheet" software is Microsoft Excel. Moreover, a typical example of the above-mentioned "retouch" software is Adobe Photoshop, and a typical example of the above-mentioned "dynamic image reproduction" software is Microsoft Windows Media Player.

Different from other image quality modes, the "Window Movie" mode is made to correspond to either one of the image quality modes, "Movie 1" or "Movie 2".

The image quality adjusting values set in the image quality mode table include, for example, gamma values and resolution. Generally in the "Text" and "Graphic" modes, it is not necessary to change these values and the default values are applied. Namely, the gamma values of reference numerals γ-1 to γ-3 and the resolution of reference numerals R-1 to R-3 in FIG. 3 are mostly default values.

On the contrary, in the "Window Movie" mode, it is preferable that the gamma value γ-4 is set to be lower than the default value so that the brightness becomes low. Moreover, it is preferable that the resolution R-4 is set to a value which is suitable for viewing.

The graphic controller 21 outputs signals, relating to drawings, to the video circuit 7 of the display device 1 according to instructions from the operating system executed in the memory 17. At this time, the image quality mode table is referred to, and the image quality adjusting values are applied to the graphic controller 21. However, the gamma value is not applied to the area where dynamic images are displayed. In other words, the image quality of the dynamic image display area and the image quality of the other display area are controlled independently. This function is generally called "overlay", and most of graphic controllers and graphic cards being currently in the market have this function.

Figure 4:
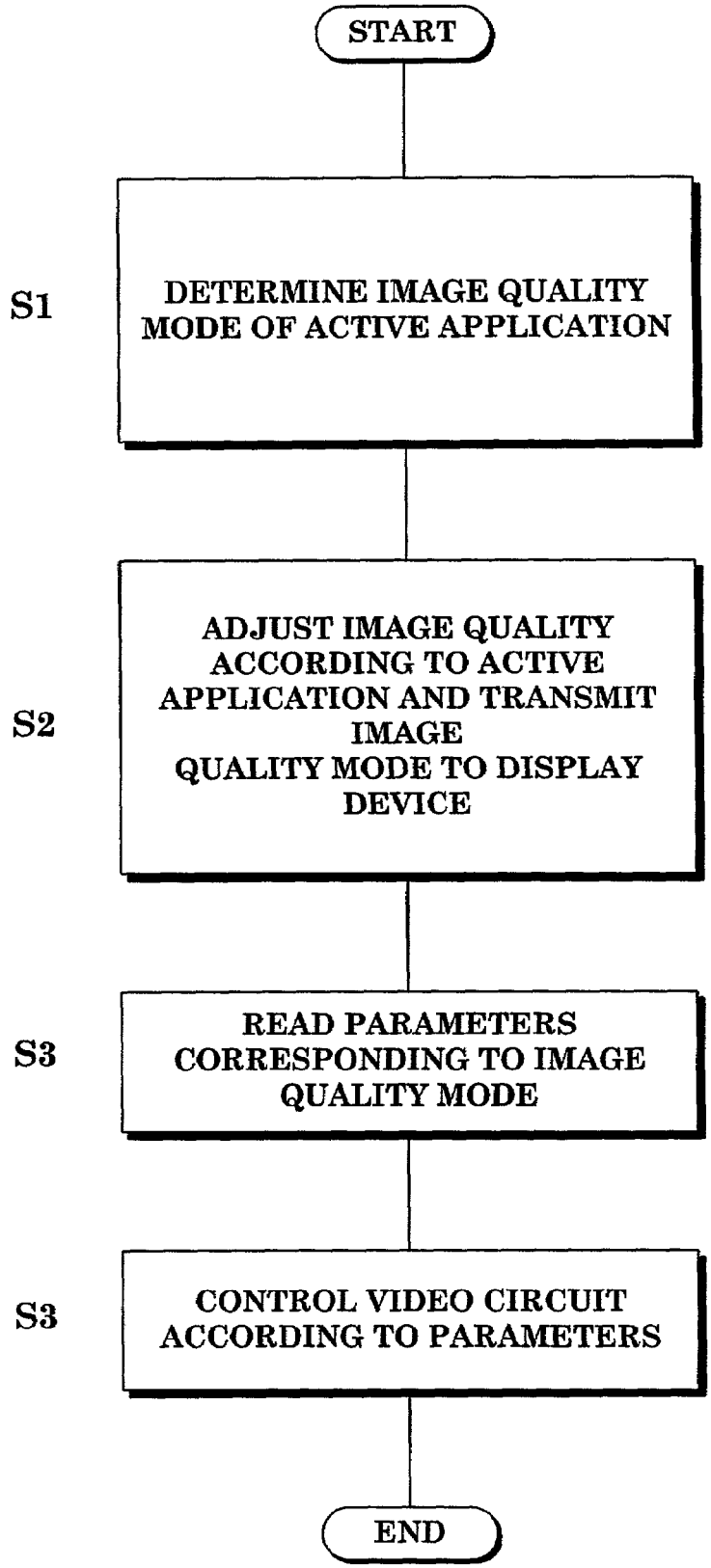
FIG. 4 is a flowchart showing a main section of the operation of the image display system.

Hereinafter, there will be explained the operation of the image display system with reference to the flowchart of FIG. 4 showing a main section in the operation.

In the computer 3, it is supposed that a plurality of application softwares have been already executed by the user. The process explained below refers to the main section in the process after the application software is changed over. This process is executed every time changeover of the application software occurs.

Step S1

The operating system (OS) recognizes an application software which is selected by the user using a pointing device such as a mouse (not shown), namely, the active application. Upon this recognition, the program determines an image quality mode of the active application.

Recognition of the active application and determination of the image quality mode are performed in the following manner, for example, when OS is Windows.

Firstly, OS obtains a Window handle of the active application, and then obtains a process ID (AID) of the active application using the Window handle. Next, OS obtains a table of process IDs of the application softwares activated on OS (these IDs are used when OS manages the on-executing programs), and then obtains a table of processes of the application software activated on OS.

Thereafter, OS obtains another process ID (CID) from the table of processes of the application software, and determines whether or not AID matches with CID. When they match with each other, the executing program name of the application software (its extension is EXE), namely, the application software is obtained from the table of processes of the application software. The application software is collated with the image quality mode table, and an image quality mode is determined depending on whether or not the application software is in this table.

Step S2

The image quality of the graphic controller 21 is adjusted so as to be suitable for the active application based on the active application and the image quality mode determined. Further, the image quality mode corresponding to the active application is transmitted to the display device 1 via the USB controller 11.

Thus, when not only the image quality adjusting values of the video circuit 7 but also the image quality adjusting values of the graphic controller 21 are made to correspond to the active application, adjustment by the graphic controller 21 makes it possible to adjust the image quality which cannot be adjusted only by the video circuit 7.

For example, when the active application is a "word processor", the image quality mode "Text" is transmitted to the display device 1.

When the image quality mode of the active application is the same as the image quality mode which has been already set, the process is ended.

Step S3

In the display device 1, parameters corresponding to the image quality mode are read based on the image quality mode received by the control section 13 and the parameter table stored in the memory 9.

When the active application is a "word processor" and its image quality mode is "Text", for example, contrast: 100, brightness: 100, color temperature: 9300K, gamma 1: off, gamma 2: off and outline correction: off are read from the parameter table of FIG. 2.

Step S4

The control section 13 controls the video circuit 7 according to the parameters read. As a result, an image is displayed on the display device 1 with the image quality according to the active application.

Since the control section 13 adjusts the video circuit 7 using the parameters corresponding to the application software selected by the user, the image quality of the display device 1 can be automatically changed over to a suitable image quality for the selected application software. Therefore, a burden on the user is extremely small, and the image quality of the display device can be adjusted according to the application software extremely easily.

The above-mentioned nine image quality modes are realized only by changing the parameters of the video circuit 7. For this reason, when the image quality is adjusted according to the active application, the entire display screen is adjusted uniformly. While "Movie 1" and the like are the image quality modes in which the brightness is high in order to display dynamic images optimally, these modes are inadequate for images other than dynamic images because the images displayed become excessively bright. When the dynamic images are displayed in the window, the entire screen, except the window, is excessively bright and is difficult to be viewed.

To solve this inconvenience, the gamma value (γ-4 in FIG. 3) for the "Window Movie" mode in the image quality mode table is set to be lower than the default value. The video circuit 7 is adjusted according to the parameters set in "Movie 1" or "Movie 2", and the gamma value of the graphic controller 21 in the computer 3 is adjusted to be lower according to the value γ-4, resulting in lower brightness of the display screen. As mentioned above, however, since the gamma value of the graphic controller 21 does not affect the dynamic image display area by the "overlay" function of the graphic controller 21, the area where images other than dynamic images are displayed is displayed darkly according to the lower gamma value of the graphic controller 21, whereas the dynamic image display area is not changed. Therefore, even if the gamma value is lowered as mentioned above, the dynamic image display area can be still displayed brightly, and the image quality is kept to be suitable both for dynamic image display area and for the other display area.

In addition, it is suitable for some dynamic image softwares and game softwares to be displayed with low resolution rather than with high resolution. In this case, it is preferable that the resolution R-4 in the image quality mode table is set to be lower.

The present invention is not limited to the above embodiment, and the following modified forms can be carried out.

(1) Instead of the CPU 15 of the computer 3 in the above embodiment, determination of active application may be carried out on the display device side via the USB controller 11. In this case, determination is made by, for example, transmitting information, useful for determining the active application, from the computer 3 to the display device 1, or by reading the information of the active application being on the computer side from the display device side.

(2) The image quality mode table may be stored in the memory 17 of the display device 1, instead of the memory 9 of the computer 3 in the above embodiment. In this case, the information relating to the active application is transmitted from the computer 3 to the display device 1, and the image quality mode of the active application is determined by the control section 13 based on the application information.

(3) Both the parameter table and the image quality mode table may be stored in the hard disc 19 of the computer 3. In this case, the parameters are read on the computer side according to the active application and are transmitted to the display device 1 so that the image quality is adjusted.

(4) A parameter table in which the application softwares are made to correspond directly to the parameters may be used instead of the image quality mode in which the image quality modes are made to correspond to the application softwares. In this case, the parameters for the active application is obtained based on this parameter table. The parameter table may be stored in the memory 9 of the display device 1 or in the hard disc 19 of the computer 3. In the former case, the active application information is transmitted to the display device 1, and in the latter case, the parameters are transmitted to the display device 1.

(5) In the image quality mode table, the application softwares may be made to correspond only to the image quality modes, and may be not necessarily made to correspond to the image quality adjusting values.

(6) As the image quality adjusting values, not both gamma value and resolution should be provided, and one of them may be provided.

(7) As the communication interface, a serial interface may be used instead of USB.

(8) Information from the graphic controller 21 may be transmitted via output signal lines instead of USB, by multiplexing output signals from the graphic controller 21 using multiplexing means or by increasing a number of output signal lines. Namely, the communication interface may be integrated.

(9) In the above-mentioned "Window Movie" mode, "display states" of the application software may be determined. For example, it is determined whether the application software is displayed in one of plural windows on the display screen ("window display") or is displayed in one maximized window covering the entire screen ("full-screen display"). The image quality mode may be changed over according to this determination.

More specifically, during "window display" of dynamic images, a first image quality mode (for example, "Movie 2") is applied in which the image quality adjusting values are set so that the image quality of the dynamic image window and the image quality of other windows are both suitable. During "full-screen display" of dynamic images, a second image quality mode (for example, "Movie 1") is applied in which the image quality adjusting values are set exclusively for the dynamic image window.

Determination as to "window display" or "full-screen display" may be made in the following manner when OS is Windows.

Firstly a size of a client region (CR) of the Window handle of the active application is obtained, and the resolution of the entire region of the display screen (MR) is obtained from the Window handle. When CR matches with MR, it is determined as "full-screen display", and when they do not match with each other, it is determined as "window display".

This modified example corresponds to claim 2 of the present invention.

The present invention may be embodied in other specific forms without departing from the spirit or essential attributes thereof and, accordingly, reference should be made to the appended claims, rather than to the foregoing specification, as indicating the scope of the invention.

What is claimed is:

1. A display device for displaying images, comprising:

a video circuit for outputting signals for displaying images according to output signals from a graphic controller included in a computer;

a communication interface to be used for communication with said computer;

first storage means for previously storing an image quality mode table in which each one of a plurality of application software executable by said computer are made to correspond to a selected one of a plurality of image quality modes and a parameter table in which parameters for adjusting said video circuit are made to correspond to each one of the plurality of image quality modes; and control means for, when one application software which is executed by said computer and is selected by a user is an active application, determining the active application via said communication interface, determining via the image quality mode table the image quality mode of the active application, after determining the image quality mode of the active application, determining via the parameter table the parameters for adjusting said video circuit and, after determining the parameters for adjusting said video circuit, adjusting said video circuit associated with the active application by means of the parameters corresponding to the active application based on the image quality mode table and the parameter table, wherein said first storage means can make the image quality modes correspond to a display state of the active application, and said control means adjusts said video circuit by means of the parameters corresponding to the display state of the active application.

2. The display device according to claim 1, wherein said first storage means can further make the image quality modes correspond to image quality adjusting values of said graphic controller, and said graphic controller is adjusted by means of the image quality adjusting values corresponding to the image quality mode of the active application.

3. The display device according to claim 2, wherein the image quality adjusting values include at least one of a gamma value and a resolution.

4. The display device according to claim 1, wherein said first storage means can further make the image quality modes image quality adjusting values of said graphic controller, and said graphic controller is adjusted by means of the image quality adjusting values corresponding to the image quality mode of the active application.

5. The display device according to claim 4, wherein the image quality adjusting values include at least one of a gamma value and a resolution.

6. The display device according to claim 1, wherein said first storage means can further make image quality adjusting values of said graphic controller correspond to display states of the application softwares, and said graphic controller is adjusted by means of the image quality adjusting values corresponding to the display state of the active application.

7. The display device according to claim 6, wherein the image quality adjusting values include at least one of a gamma value and a resolution.

8. The display device according to claim 1, wherein the parameters include at least one of gamma value, contrast, brightness, color temperature and outline correction. corresponding to the display state of the active application.

9. A display device for displaying images, comprising:

a video circuit for outputting signals for displaying images according to output signals from a graphic controller included in a computer;

a communication interface to be used for communication with said computer;

first storage means for previously storing an image quality mode table in which each one of a plurality of application software executable by said computer are made to correspond to a selected one of a plurality of image quality modes and a parameter table in which parameters for adjusting said video circuit are made to correspond to each one of the plurality of image quality modes; and control means for, when one application software which is executed by said computer and is selected by a user is an active application, determining the active application via said communication interface, determining via the image quality mode table the image quality mode of the active application, after determining the image quality mode of the active application, determining via the parameter table the parameters for adjusting said video circuit and, after determining the parameters for adjusting said video circuit, adjusting said video circuit associated with the active application by means of the parameters corresponding to the active application based on the image quality mode table and the parameter table, wherein said first storage means can make the image quality modes correspond to a display state of the active application, and said control means adjusts said video circuit by means of the parameters corresponding to the display state of the active application.

10. The display device according to claim 9, wherein said first storage means can further make the image quality modes correspond to image quality adjusting values of said graphic controller, and said graphic controller is adjusted by means of the image quality adjusting values corresponding to the image quality mode of the active application.

11. The display device according to claim 10, wherein the image quality adjusting values include at least one of a gamma value and a resolution.

12. The display device according to claim 11, wherein said first storage means can further make the image quality modes correspond to image quality adjusting values of said graphic controller, and said graphic controller is adjusted by means of the image quality adjusting values corresponding to the image quality mode of the active application.

13. The display device according to claim 12, wherein the image quality adjusting values include at least one of a gamma value and a resolution.

14. The display device according to claim 9, wherein said first storage means can further make image quality adjusting values of said graphic controller correspond to display states of the application softwares, and said graphic controller is adjusted by means of the image quality adjusting values corresponding to the display state of the active application.

15. The display device according to claim 14, wherein the image quality adjusting values include at least one of a gamma value and a resolution.

16. The display device according to claim 9, wherein the parameters include at least one of gamma value, contrast, brightness, color temperature and outline correction.

17. A display device for displaying images, comprising:

a video circuit for outputting signals for displaying images according to output signals from a graphic controller included in a computer;

a communication interface to be used for communication with said computer;

first storage means for previously storing a parameter table in which parameters for adjusting said video circuit are made to correspond to one of a plurality of image quality modes, respectively; and control means for, when an application software which is executed by said computer which previously stores an image quality mode table in which application softwares are made to correspond to image quality modes, respectively and is selected by a user is an active application, determining the image quality mode of the active application, after determining the image quality mode of the active application, determining via the parameter table the parameters for adjusting said video circuit and adjusting said video circuit associated with the active application by means of the parameters corresponding to the active application based on the image quality mode of the active application determined by said computer and received via said communication interface and the parameter table, wherein said first storage means is operative to make image quality adjusting values of said graphic controller correspond to a display state of the active application, and said graphic controller is adjusted by means of the image quality adjusting values corresponding to the display state of the active application.

18. The display device according to claim 17, wherein said first storage means can further make parameters correspond to display states of the application softwares, and said control means adjusts said video circuit also by means of the parameters corresponding to the display state of the active application.

19. The display device according to claim 18, wherein said first storage means can further make the application softwares correspond to image quality adjusting values of said graphic controller, and said graphic controller is adjusted by means of the image quality adjusting values corresponding to the active application.

20. The display device according to claim 19, wherein the image quality adjusting values include at least one of a gamma value and a resolution.

21. The display device according to claim 17, wherein said first storage means can further make the application softwares correspond to image quality adjusting values of said graphic controller, and said graphic controller is adjusted by means of the image quality adjusting values corresponding to the active application.

22. The display device according to claim 21, wherein the image quality adjusting values include at least one of a gamma value and a resolution.

23. The image display system according to claim 17, wherein the image quality adjusting values include at least one of a gamma value and a resolution.

24. The display device according to claim 17, wherein parameters include at least one of gamma value, contrast, brightness, color temperature and outline correction.

25. A display device for displaying images, comprising:

a video circuit for outputting signals for displaying images according to output signals from a graphic controller included in a computer;

a communication interface to be used for communication with said computer;

control means for, when an application software, which is executed by said computer which previously stores an image quality mode table in which application softwares are made to correspond to image quality modes, respectively and a parameter table in which the application softwares to be executed by said computer are made to correspond to parameters for adjusting said video circuit, respectively and is selected by a user is an active application, determining via the image quality mode table the image quality mode of the active application, after determining the image quality mode of the active application, determining via the parameter table the parameters for adjusting said video circuit and, after determining the parameters for adjusting said video circuit, adjusting said video circuit associated with the active application by means of the parameters corresponding to the active application determined by said computer and received via said communication interface; and storage means to make image quality adjusting values of said graphic controller correspond to display states of the application softwares, wherein said graphic controller is adjusted by means of the image quality adjusting values corresponding to the display state of the active application.

26. The display device according to claim 25, wherein the image quality adjusting values include at least one of a gamma value and a resolution.

27. An image display system for displaying images, comprising:

a display device having a video circuit for adjusting an image quality;

a computer having a graphic controller for displaying images on said display device; and a communication interface to be used for communication between said computer and said display device, wherein said display device includes:

first storage means for previously storing an image quality mode table in which application softwares to be executed by said computer are made to correspond to image quality modes, respectively and a parameter table in which parameters for adjusting said video circuit are made to correspond to the image quality modes, respectively; and control means for adjusting said video circuit by means of the parameters, wherein said computer includes determining means for determining an active application, wherein said control means determines via the image quality mode table the image quality mode of the active application, after determining the image quality mode of the active application, determines via the parameter table the parameters for adjusting said video circuit and, after determining the parameters for adjusting said video circuit, adjusts said video circuit associated with the active application by means of the parameters corresponding to the active application based on active application information received from said computer via said communication interface, the image quality mode table and the parameter table, wherein said first storage means can make the image quality modes correspond to a display of the active application, and said control means adjusts said video circuit also by means of the parameters corresponding to the display state of the active application.

28. The image display system according to claim 27, wherein said first storage means can further make the image quality modes correspond to image quality adjusting values of said graphic controller, and said graphic controller is adjusted by means of the image quality adjusting values corresponding to the image quality mode of the active application.

29. The image display system according to claim 28 wherein the image quality adjusting values include at least one of a gamma value and a resolution.

30. The image display system according to claim 27, wherein said first storage means can further make image quality adjusting values of said graphic controller correspond to display states of the application softwares, and said graphic controller is adjusted by means of the image quality adjusting values corresponding to the image quality mode of the active application.

31. The display device according to claim 8, wherein the image quality adjusting values include at least one of a gamma value and a resolution.

32. The image display system according to claim 27, wherein the parameters include at least one of gamma value, contrast, brightness, color temperature and outline correction.

33. An image display system for displaying images, comprising:

a display device having a video circuit for adjusting an image quality;

a computer having a graphic controller for displaying images on said display device; and a communication interface to be used for communication between said computer and said display device, wherein said display device includes:

first storage means for previously storing a parameter table in which parameters for adjusting said video circuit are made to correspond to image quality modes, respectively; and control means for adjusting said video circuit by means of the parameters, wherein said computer includes:

determining means for determining an active application; and second storage means for previously storing an image quality mode table in which application softwares are made to correspond to the image quality modes, respectively, wherein said control means adjusts said video circuit by means of the parameters corresponding to the image quality mode of the active application received from said computer via said communication interface, and wherein said second storage means can further make the image quality modes correspond to image quality adjusting values of said graphic controller, and wherein said graphic controller is adjusted by means of the image quality adjusting values corresponding to the image quality mode of the active application, and wherein the image quality mode of the active application is determined and, after determining the image quality mode of the active application, the parameters for adjusting said video circuit are determined.

34. The image display system according to claim 33, wherein said second storage means can further make the image quality modes correspond to display states of the application softwares, and said control means adjusts said video circuit by means of the parameters corresponding to the display state of the active application.

35. The image display system according to claim 33, wherein said second storage means can further make image quality adjusting values of said graphic controller correspond to display states of the application softwares, and said graphic controller is adjusted by means of the image quality adjusting values corresponding to the image quality mode of the active application.

36. The image display system according to claim 35, wherein the image quality adjusting values include at least one of a gamma value and a resolution.

37. The image display system according to claim 33, wherein the image quality adjusting values include at least one of a gamma value and a resolution.

38. The image display system according to claim 33, wherein the parameters include at least one of gamma value, contrast, brightness, color temperature and outline correction.

39. An image display system for displaying images, comprising:

a display device having a video circuit for adjusting an image quality;

a computer having a graphic controller for displaying images on said display device; and a communication interface to be used for communication between said computer and said display device;

wherein said display device includes control means for adjusting said video circuit by means of parameters, wherein said computer includes:

determining means for determining an active application; and storage means for previously storing an image quality mode table in which application softwares are made to correspond to image quality modes, respectively and a parameter table in which the parameters for adjusting said video circuit are made to correspond to the image quality modes, respectively, wherein said control means adjusts said video circuit by means of parameters of the active application received from said computer via said communication interface, wherein said storage means can further make the image quality modes correspond to display states of the application softwares, wherein said control means adjusts said video circuit also by means of the parameters corresponding to the display state of the active application, wherein the image quality mode of the active application is determined via the image quality mode table and, after determining the image quality mode of the active application, determining via the parameter table the parameters for adjusting said video circuit are determined via the parameter table.

40. The image display system according to claim 39, wherein said storage means can further make the image quality modes correspond to image quality adjusting values of said graphic controller, and said graphic controller is adjusted by means of the image quality adjusting values corresponding to the image quality mode of the active application.

41. The image display system according to claim 40, wherein the image quality adjusting values include at least one of a gamma value and a resolution.

42. The image display system according to claim 39, wherein said storage means can further make image quality adjusting values of said graphic controller correspond to display states of the application softwares, and said graphic controller is adjusted by means of the image quality adjusting values corresponding to the image quality mode of the active application.

43. The image display system according to claim 42, wherein the image quality adjusting values include at least one of a gamma value and a resolution.

44. The image display system according to claim 39, wherein the parameters include at least one of gamma value, contrast, brightness, color temperature and outline correction.

* * * * *